US007331384B2

(12) United States Patent
Scrantz

(10) Patent No.: US 7,331,384 B2
(45) Date of Patent: Feb. 19, 2008

(54) STABBERLESS PIPE HANDLING SYSTEM

(76) Inventor: Ronald James Scrantz, 1506 Grand Anus Hwy., Breaux Bridge, LA (US) 70517

( * ) Notice: Subject to any disclaimer, the term of this patent is extended or adjusted under 35 U.S.C. 154(b) by 221 days.

(21) Appl. No.: 11/114,346

(22) Filed: Apr. 26, 2005

(65) Prior Publication Data

US 2005/0269136 A1 Dec. 8, 2005

Related U.S. Application Data

(60) Provisional application No. 60/564,881, filed on Apr. 26, 2004.

(51) Int. Cl.
*E21B 19/18* (2006.01)

(52) U.S. Cl. ..... 166/77.51; 166/77.1; 166/77.3

(58) Field of Classification Search ..... 166/77.51, 166/77.1, 77.3; 175/85
See application file for complete search history.

(56) References Cited

U.S. PATENT DOCUMENTS

2002/0162665 A1* 11/2002 Adams et al. ..... 166/382

* cited by examiner

*Primary Examiner*—David Bagnell
*Assistant Examiner*—Brad Harcourt
(74) *Attorney, Agent, or Firm*—Browning Bushman P.C.

(57) ABSTRACT

A pipe handling apparatuses is suspended between the bails of a rig to raise, lower and laterally move a single joint of pipe that is being added to a string of pipe extending into a well.

15 Claims, 4 Drawing Sheets

STABBERLESS PIPE HANDLING SYSTEM

CROSS REFERENCE TO RELATED APPLICATION

This application claims priority from and incorporates herein U.S. Provisional Application No. 60/564,881 filed Apr. 26, 2004.

BACKGROUND OF THE INVENTION

Prior Art Setting

The present invention provides a means for positioning a joint of pipe relative to a string of pipe that is being inserted into a well.

Conventionally, on most older drilling rigs, a person must position himself at an elevated position in the derrick of the rig above the rig floor, typically 30 or 40 ft. from the top of the pipe string that is being lowered into the well in order to align and steady the pipe joint that is being added or made up into the string. This person is referred to as the stabber.

The stabber is not required on modern drilling rigs that employ automated equipment to manipulate the joint as it is being added to the pipe string. These modern systems are generally complicated, expensive and relatively slow acting.

BRIEF SUMMARY OF THE INVENTION

The present invention provides all of the necessary functions required in lifting, aligning, lowering and supporting the pipe joint as it is being added to the pipe string without the need for the complicated, slow, expensive mechanized stabberless systems currently employed.

In one form of the invention, a fluid operated extensible cylinder operated by either hydraulic or air pressure, is suspended between the bails used to support the elevator from the rig traveling block or top drive. Control and power lines extend between the cylinder and the operator on the rig floor. An operator located on the rig floor remotely controls the extension and contraction of the cylinder.

DESCRIPTION OF THE PREFERRED EMBODIMENTS

Figure 1:
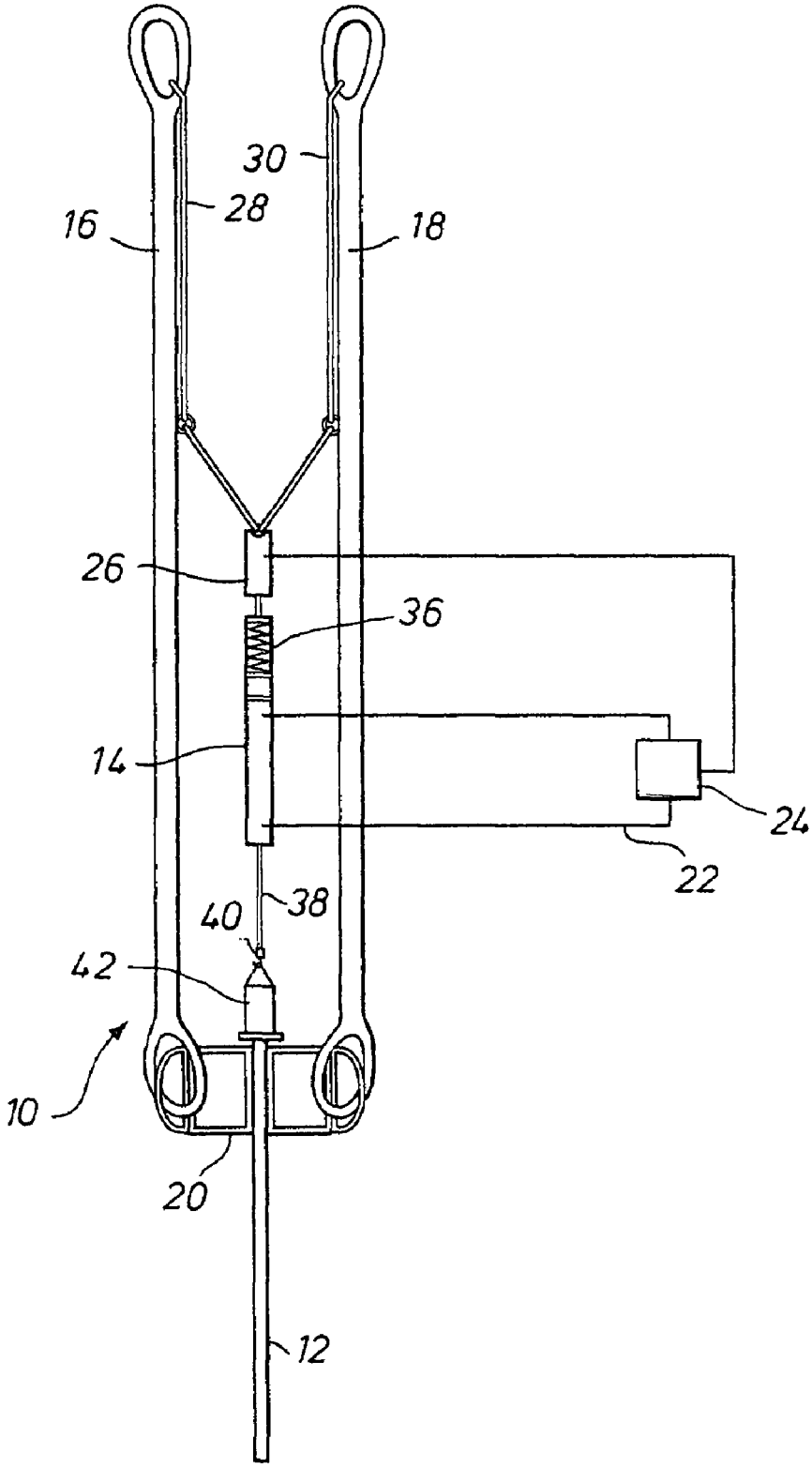
FIG. 1 is a vertical elevation, partially broken away, illustrating a form of the pipe handling system of the present invention.

Referring to FIG. 1, a pipe joint 12 is illustrated supported by the pipe handling system of the present invention, indicated generally at 10, as the joint is being added to a pipe string (not illustrated) extending downwardly into a well (not illustrated). A fluid operated extensible piston/cylinder assembly 14, operated by either hydraulic or air pressure, is suspended between bails 16 and 18 that are in turn used to support an elevator 20 from the rig traveling block or top drive (not illustrated). Control and power lines, indicated generally at 22, extend between the assembly 14 and an operating control and power station 24 on the rig. Control and power lines included in the lines 22 extend to the elevator 20 and load cell 26 to provide monitoring and control functions as desired. A human operator (not illustrated) located on the rig floor monitors instrument readings and remotely controls the extension and contraction and other movements of the assembly 14 and elevator 20 from the power station 24.

Figure 2:
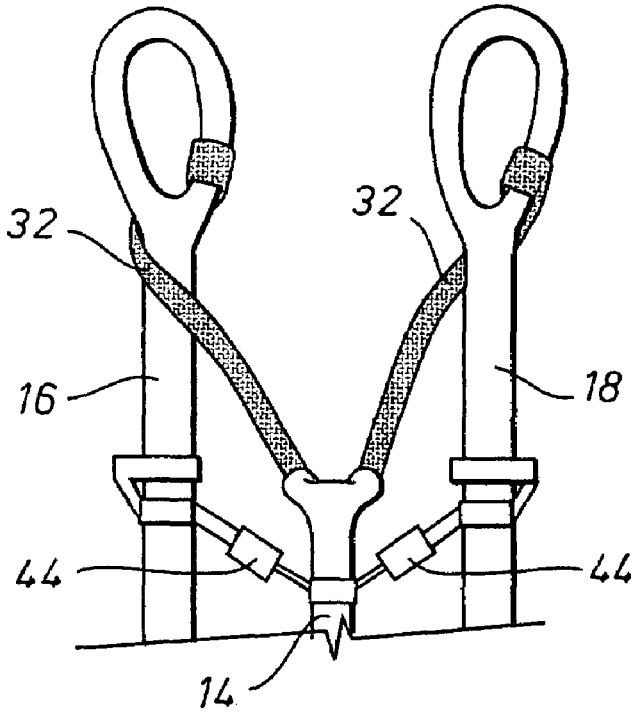
FIG. 2 is a vertical elevation, partially broken away, illustrating a modified form of suspending the pipe handling system of the present invention.

The cylinder assembly 14 is suspended by suitable means, such as flexible steel lines 28 and 30 that are connected to upper eyes of the bails 16 and 18. The cylinder assembly 14 may also be suspended by nylon straps 32, as illustrated in FIG. 2. The straps 32 connect to the eyes of the bails with one strap extending around bail 16 in one direction and the second strap extending in the opposite direction around bail 18 back to the cylinder assembly. Bringing the straps 32 around the bails in opposite directions has the result of exactly centering the central axis of the cylinder assembly between the central axis of the two bails within a plane that includes the bails.

Referring again to FIG. 1, a remotely monitored load cell 26 is interposed between the cylinder assembly 14 and its suspension from the lines 28 and 30. A mechanical spring 36 positioned between the cylinder assembly and the load cell can accommodates relative movement of the assembly between the load cell and the top of the pipe string as the weight of the joint is being relieved as it is being stabbed into and made up into the top of the pipe string.

A flexible nylon sling 38 is hooked between the bottom of the cylinder assembly rod and the top of a hook swivel 40, which in turn forms the upper connection of a lifting nubbin or single joint elevator 42 that has been screwed into or latched around the top of the joint 12 that is being added to the pipe string.

Powered kick out devices, indicated at 44 in FIG. 2 may be actuated from the power station 24 to move the hydraulic cylinder assembly laterally relative to the axis of the bails 16 and 18. The kick out devices 44 may be actuated to extend the lower end of the pipe handling assembly 10 away from the bails toward the side of the rig where the joint 12 is to be picked up.

Figure 3:
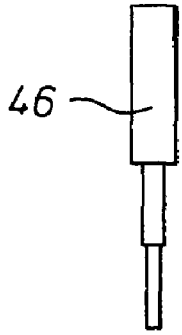
FIG. 3 illustrates a telescoping cylinder that may be employed in the pipe handling system of the present invention.
Figure 4:
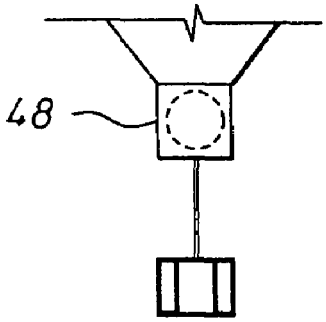
FIG. 4 illustrates a cable and reel arrangement that may be used in the pipe handling system of the present invention.

The cylinder assembly 14 may provide an 8 ft. stroke of the rod through the cylinder. The stroke may be longer or shorter depending upon the length of the bails and/or other rig up limitations. A multiplying arrangement, such as illustrated in FIGS. 3 and 4, may be provided with the suspension of the cylinder assembly 14 from the bail eyes such that the movement of the device performing the axial extension and contraction produces twice as much or more axial movement in the pipe. When a multiplying arrangement is used, shorter bails may be used.

The hydraulic cylinder assembly 14 may be replaced with a telescoping fluid cylinder-piston arrangement, such as 46 in FIG. 3 or a power reel with steel cable 48 such as illustrated in FIG. 4. The telescoping cylinder assembly 46 and the power reel 48 may, if desired, be suspended from the steel spring 36. The power reel 48 may be powered by fluid pressure or electricity.

In operation, the lift nubbin (or single joint elevator) is secured to the top of the joint and the rig traveling block (or top drive) is raised to raise the bails, elevator, attached joint 12 and stabberless handling system above the top of the string suspended in the well and supported from the rig floor. The cylinder assembly 14, during this process, is moved to its retracted (foreshortened) position with the cylinder rod fully contained within the cylinder. The traveling block stops its upward movement when the pin of the joint 12 is elevated slightly above the box at the top of the string suspended in the well.

An operator at the floor level manipulates controls at the power station 24 to cause the cylinder assembly 14 to extend lengthwise, which in turn lowers the joint 12 until its pin is lowered into engagement with the box at the top of the suspended string. This lowering process reduces the amount of weight supported by the load cell and the operator is given a visual indication of the reduction by monitoring the instruments at the power station. This visual indication of the reduced load may be used to coordinate the final movement downwardly of the joint 12.

Once the joint 12 has been stabbed into the top of the string, a hydraulic tong (not illustrated) is positioned around the joint 12 and the joint is rotated until the proper makeup with the string has been obtained. The hook swivel at the top of the lift nubbin and the flexible nylon sling supporting the lift nubbin from the cylinder rod accommodate the rotary motion imported into the joint 12 during the makeup process. During this screwing together in the makeup process, the additional downward movement imparted to the joint 12 as it makes up into the box of the string is accommodated by the spring. This lowering of the joint as it is threaded into the box also increases the indication of weight acting upon the load cell and is used by the operator to regulate the amount of movement of the pipe 12 required to maintain the pipe alignment while simultaneously accommodating the downward movement.

The fluid system regulating the extension and retraction of the cylinder rod within the cylinder 14 may be automatically regulated with a suitable pressure regulation system within the power station 24 to maintain a constant amount of force acting on the load cell during the makeup process.

When the joint 12 has been made up into the top of the string, the elevator is closed around the joint and the joint, and the pipe string to which it has been attached, is raised permitting release of the spider (not illustrated) on the rig floor holding the pipe string so that the lengthened string may be lowered until the joint 12 becomes the uppermost joint in the string. The spider is then set on the joint 12 to support the string, the elevator is released and the foregoing procedure is then repeated with another joint similar to the joint 12.

Figure 5:
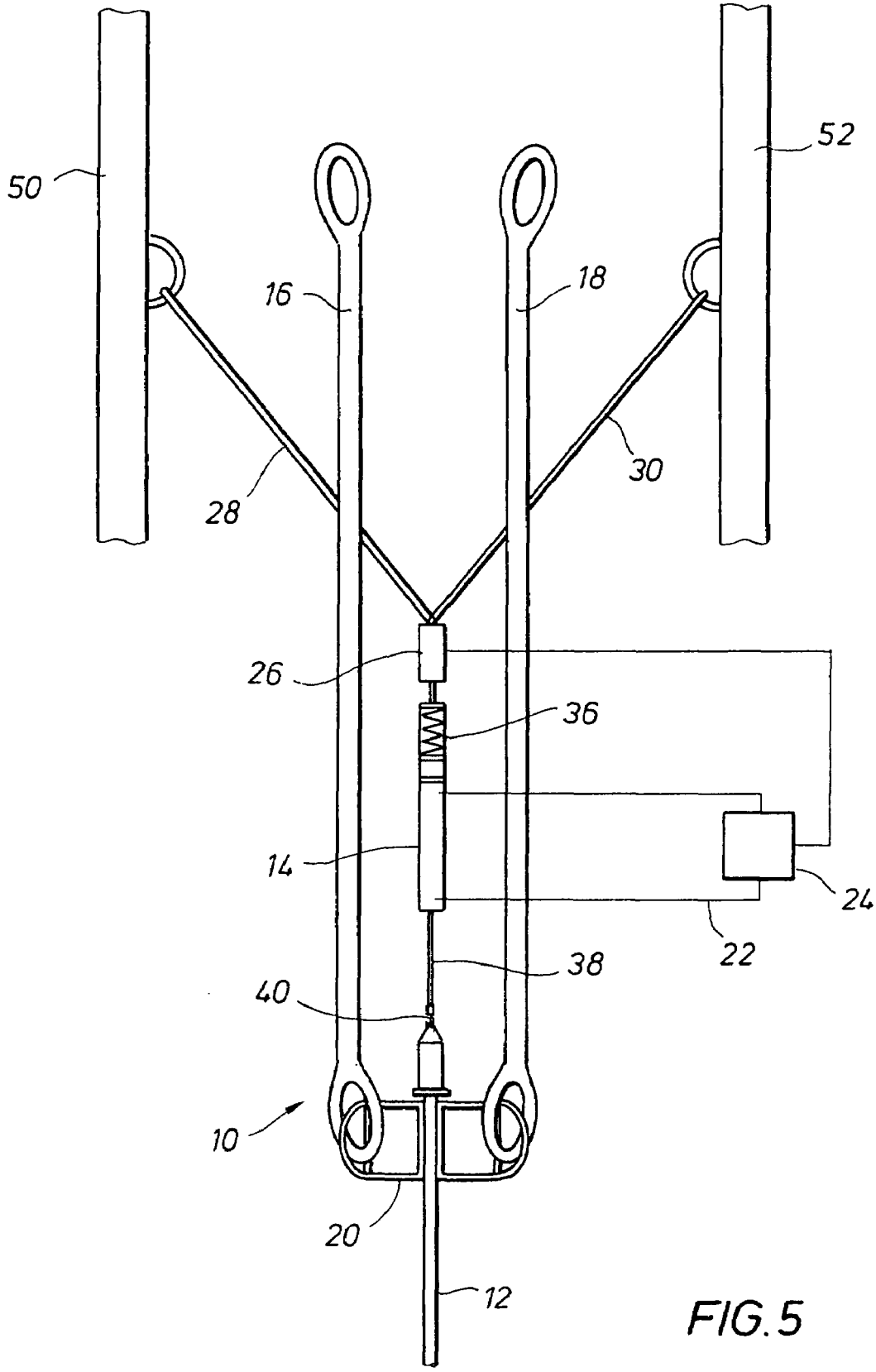
FIG. 5 is a figure similar to FIG. 1 illustrating another form of suspending the pipe handling system of the present invention.
Figure 6:
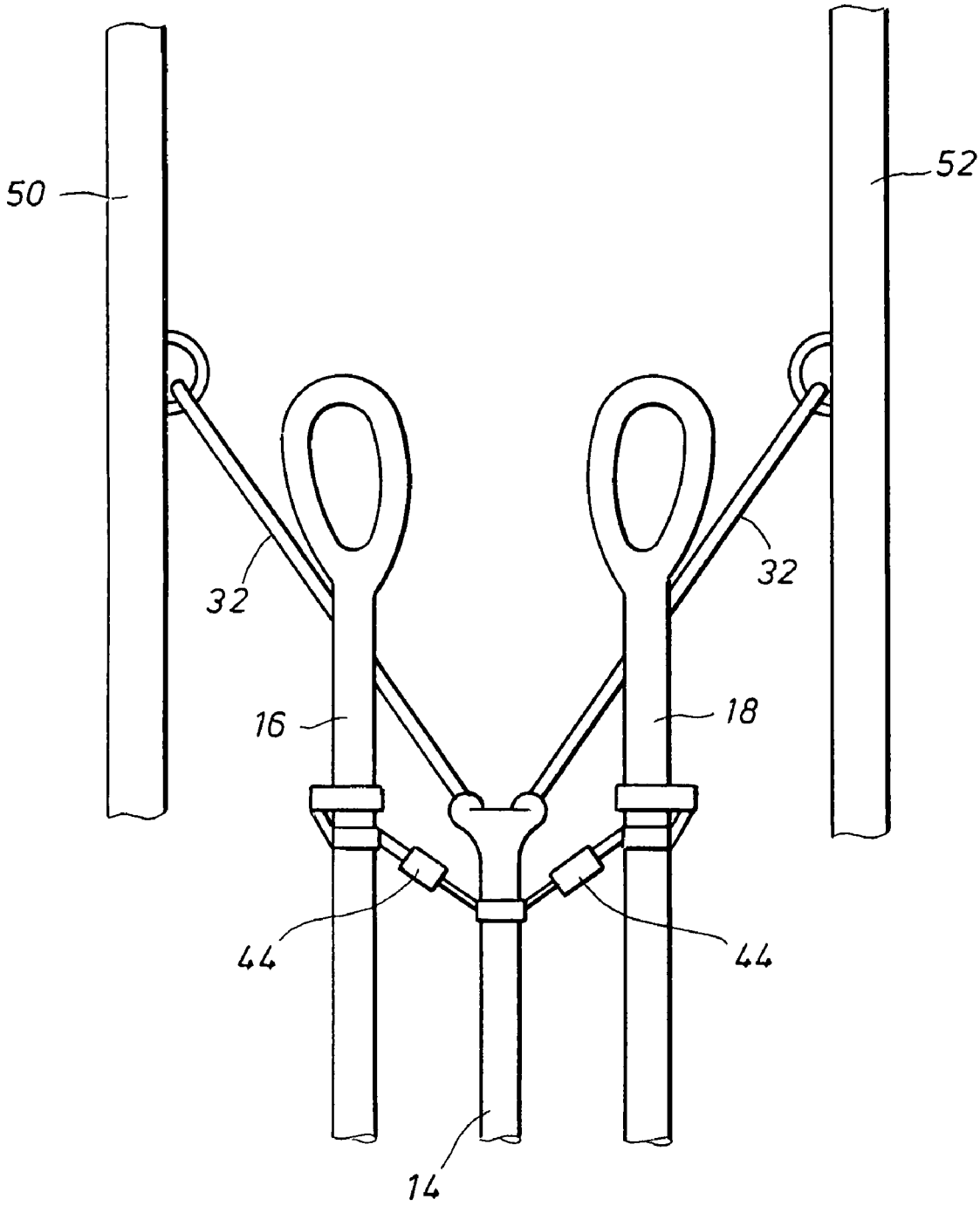
FIG. 6 is a figure similar to FIG. 2 illustrating another form of suspending the pipe handling system of the present invention.

Referring now to FIGS. 5 and 6, there are illustrated alternative methods of suspending the pipe handling system of the present invention. With reference to FIG. 5, it can be seen that lines 28 and 30, rather than being attached to bails 16 and 18 are attached to a part of the rig structure shown schematically as structural members 50 and 52.

While specific forms of the invention have been illustrated and described in detail, it will be appreciated that other forms of the stabberless pipe handling device may be made and used without departing from the spirit and scope of the invention, which is more fully defined in the following claims.

What is claimed is:

1. A powered stabber for use with axially extending bails in a well drilling or completion rig, comprising:

an axially extensible and contractible pipe holding member adapted to be suspended in the space defined between the bails of the rig whereby the axis of said member is substantially parallel with the axes of said bails, a securing fixture for securing said member between said bails whereby said member may be axially extended and retracted relative to said bails, a pipe engaging component at one end of said member for engagement with a pipe to be added to or removed from a string of pipe extending substantially coaxially with said member, and a control system operative for controlling the movement of said member and/or said pipe engagement component.

2. A stabber as defined in claim 1 wherein said control system is adapted to elongate and/or foreshorten said member.

3. A stabber as defined in claim 2 wherein said control system is adapted to maintain a controlled lifting force on said pipe engagement component.

4. A stabber as defined in claim 1 wherein said control system is adapted to control movement of said pipe engagement component laterally and/or axially relative to said bails.

5. A stabber as defined in claim 1 wherein said securing fixture comprises straps adapted to connect said member to said bails or a rig structure supporting said bails.

6. A stabber as defined in claim 1 wherein said member comprises a piston/cylinder adapted to elongate and/or contract when powered by a pressurized fluid.

7. A stabber as defined in claim 1 wherein said pipe engaging component comprises a single joint elevator.

8. A stabber as defined in claim 1 further including a load cylinder for measuring the load supported by said stabber.

9. A stabber as defined in claim 1 further including monitoring equipment for measuring the load supported by said stabber.

10. A stabber as defined in claim 1 wherein said control system includes means for maintaining a constant support force exerted on pipe supported by said stabber.

11. A stabber as defined in claim 6 further comprising a load cell for measuring the suspended weight acting on said piston/cylinder.

12. A stabber as defined in claim 11 wherein said pipe engaging component includes a rotatable connection for permitting relative rotation between the pipe and the piston/cylinder.

13. A stabber as defined in claim 12 wherein said securing fixture comprises flexible restraining members adapted to connect said member to said bails or a rig structure supporting said bails.

14. A stabber as defined in claim 13 wherein said securing fixture comprises nylon straps.

15. A stabber as defined in claim 13 further including a spring disposed between said load cell and said piston/cylinder for accommodating relative axial movement between said pipe and said piston/cylinder.

* * * * *